US006446309B1

(12) United States Patent
DeWeese

(10) Patent No.: US 6,446,309 B1
(45) Date of Patent: Sep. 10, 2002

(54) CAULK GUN HANDLE CUSHION SYSTEM

(76) Inventor: Frank M. DeWeese, 8900 Old Barres Rd., Louiville, KY (US) 40228

( * ) Notice: Subject to any disclaimer, the term of this patent is extended or adjusted under 35 U.S.C. 154(b) by 0 days.

(21) Appl. No.: 09/658,972

(22) Filed: Sep. 11, 2000

(51) Int. Cl.[7] ..... B25G 1/01; B25G 3/00

(52) U.S. Cl. ..... 16/430; 16/421; 16/431; 16/DIG. 12

(58) Field of Search ..... 16/430, 431, 422, 16/DIG. 12, 421; 81/489, 427.5, 177.1, 415; 74/551.9, 543; 222/80, 325, 326, 327, 389, 391

(56) References Cited

U.S. PATENT DOCUMENTS 2,425,245 A * 8/1947 Johnson ..... 16/431
4,304,158 A * 12/1981 Brunosson et al. ..... 81/417
5,105,648 A * 4/1992 Steiner et al. ..... 81/427.5
5,248,068 A 9/1993 Goergen et al. ..... 222/326
5,253,557 A * 10/1993 Dolak ..... 81/427.5
5,321,868 A * 6/1994 Hudson ..... 16/430
5,809,853 A * 9/1998 Hudson ..... 81/427.5
5,819,594 A 10/1998 Sjovall ..... 74/551.9
5,845,364 A 12/1998 Chen
5,857,241 A 1/1999 Camp, Jr. et al.
5,890,260 A 4/1999 Gaunt
6,161,256 A * 12/2000 Quiring et al. ..... 16/431
6,212,979 B1 * 4/2001 Wang ..... 81/427.5

* cited by examiner

*Primary Examiner*—Chuck Y. Mah
(74) *Attorney, Agent, or Firm*—Joseph N. Breaux

(57) ABSTRACT

A caulk gun handle cushion assembly system that includes cushions, conformably securable to the front and back hand grips, of a caulk gun handle assembly for minimizing the compression forces generated against the interior of the user's hands during long periods of use. Each of the front and back hand grip cushions has a receiving cavity lined with an adhesive layer for permanently bonding with a respective front and back hand grip of the caulk gun handle assembly.

1 Claim, 5 Drawing Sheets

FIG.4
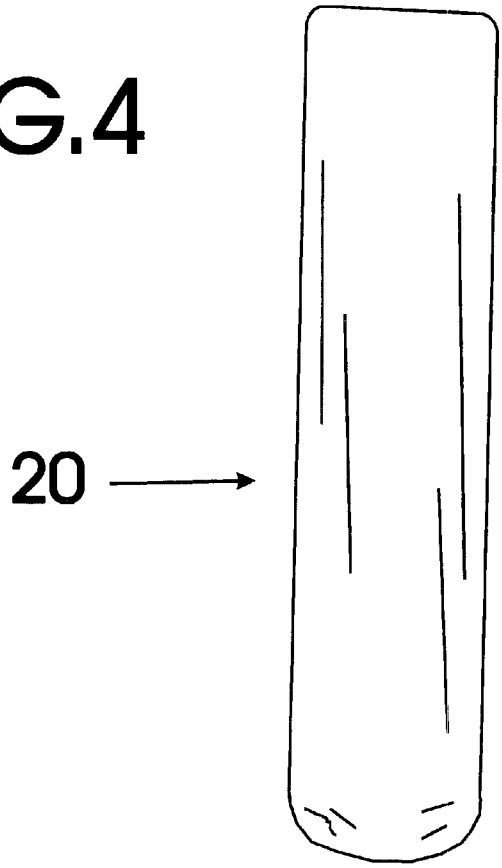
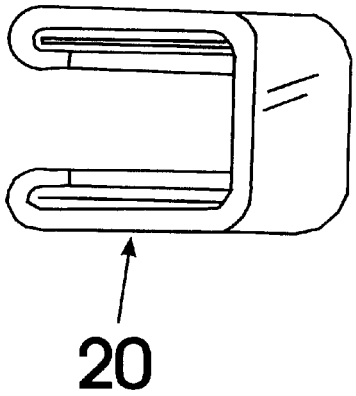
FIG.5
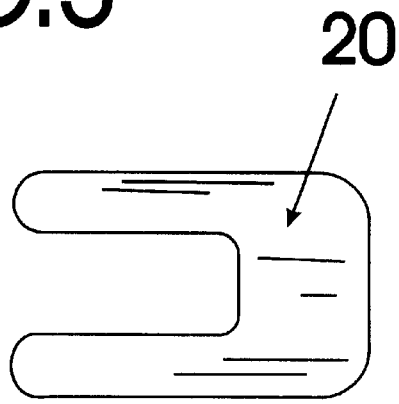
FIG.6

CAULK GUN HANDLE CUSHION SYSTEM

TECHNICAL FIELD

The present invention relates to cushioned hand grip systems for tools and more particularly to a caulk gun handle cushion system for use with a caulk gun handle grip assembly of a caulk gun having a forwardly curved forward handle grip and rearwardly curved back handle grip; the caulk gun handle cushion system including a back grip cushion adapted for connection with a back handle grip of a caulk gun handle grip assembly and a forward grip cushion for the forward handle grip of a caulk gun handle grip assembly; the back grip cushion includes a interior caulk gun handle receiving channel coated with an adhesive layer and having left, lower and right overlapping lip sections each also covered with an adhesive layer; the interior caulk gun handle receiving cavity being sized and shaped to conformably receive therein the back handle grip of the caulk gun handle grip assembly; the front grip cushion having an inner surface defining a forward handle grip receiving cavity covered with an adhesive layer and having left, lower and right overlapping lip sections each also covered with an adhesive layer; the forward handle grip receiving cavity being sized and shaped to conformably receive the forward handle grip of the caulk gun handle grip assembly.

BACKGROUND ART

Caulk guns typically include a front and back handle forming a handle assembly that is squeezed together by the user to generate force for forcing caulk, adhesives, etc. contained within the tube out through the tip of the tube. Although the handle assembly allows the user to generate this force with one hand, the handle grips of the caulk gun are typically hard and can generate uncomfortable compression injuries to the inner surface of the user's hands if used for an extended period of time. It would be a benefit, therefor, to have a caulk gun handle cushion assembly that included cushions, conformably securable to the front and back hand grips that would minimize the compression forces generated against the interior of the user's hands.

GENERAL SUMMARY DISCUSSION OF INVENTION

It is thus an object of the invention to provide a caulk gun handle cushion system for use with a caulk gun handle grip assembly of a caulk gun having a forwardly curved forward handle grip and rearwardly curved back handle grip; the caulk gun handle cushion system including a back grip cushion adapted for connection with a back handle grip of a caulk gun handle grip assembly and a forward grip cushion for the forward handle grip of a caulk gun handle grip assembly; the back grip cushion includes a interior caulk gun handle receiving channel coated with an adhesive layer and having left, lower and right overlapping lip sections each also covered with an adhesive layer; the interior caulk gun handle receiving cavity being sized and shaped to conformably receive therein the back handle grip of the caulk gun handle grip assembly; the front grip cushion having an inner surface defining a forward handle grip receiving cavity covered with an adhesive layer and having left, lower and right overlapping lip sections each also covered with an adhesive layer; the forward handle grip receiving cavity being sized and shaped to conformably receive the forward handle grip of the caulk gun handle grip assembly.

Accordingly, a caulk gun handle cushion system is provided. The caulk gun handle cushion system for use with a caulk gun handle grip assembly of a caulk gun having a forwardly curved forward handle grip and rearwardly curved back handle grip; the caulk gun handle cushion system including a back grip cushion adapted for connection with a back handle grip of a caulk gun handle grip assembly and a forward grip cushion for the forward handle grip of a caulk gun handle grip assembly; the back grip cushion includes a interior caulk gun handle receiving channel coated with an adhesive layer and having left, lower and right overlapping lip sections each also covered with an adhesive layer; the interior caulk gun handle receiving cavity being sized and shaped to conformably receive therein the back handle grip of the caulk gun handle grip assembly; the front grip cushion having an inner surface defining a forward handle grip receiving cavity covered with an adhesive layer and having left, lower and right overlapping lip sections each also covered with an adhesive layer; the forward handle grip receiving cavity being sized and shaped to conformably receive the forward handle grip of the caulk gun handle grip assembly.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 4 is a front side plan view of back grip cushion of the caulk gun handle cushion system of the present invention.

FIG. 5 is a top side plan view of back grip cushion of the caulk gun handle cushion system of the present invention showing the adhesive layer on the inside surfaces of the left and right overlapping lip sections.

FIG. 6 is an underside plan view of back grip cushion of the caulk gun handle cushion system of the present invention.

EXEMPLARY MODE FOR CARRYING OUT THE INVENTION

Figure 1:
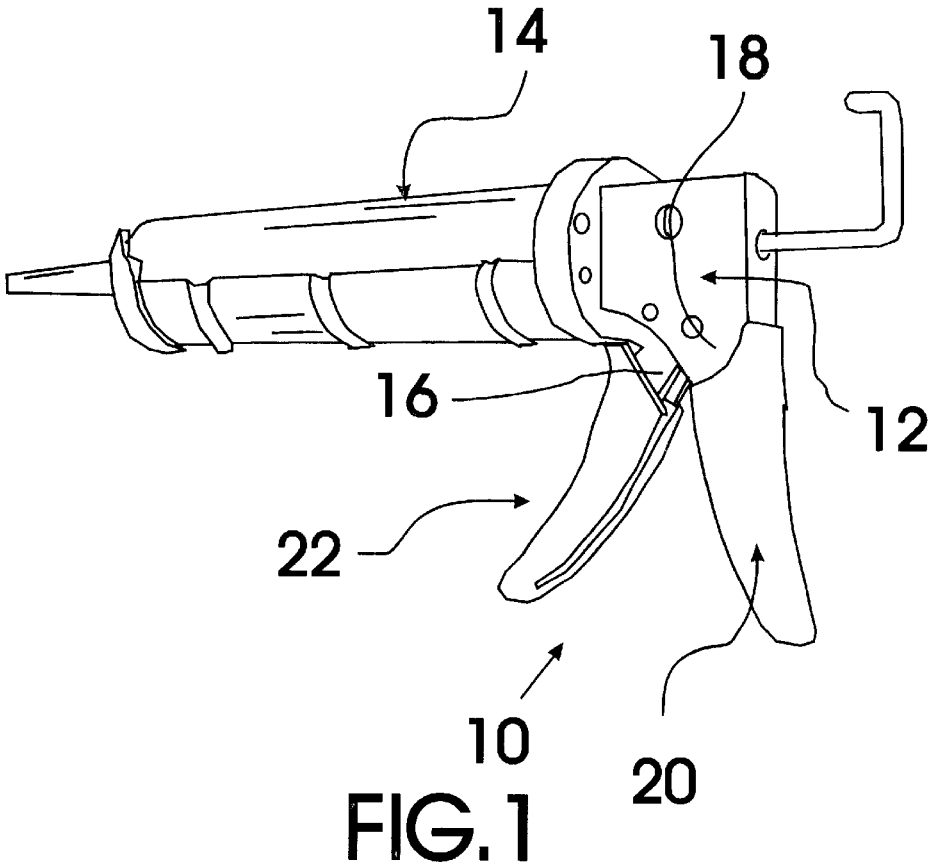
FIG. 1 is a perspective view showing a representative caulk gun having forward and rear caulk gun handles with the caulk gun handle system of the present invention installed and showing the front grip cushion of the caulk gun handle cushion system adhesively secured to the front caulk gun handle of the representative caulk gun and the back grip cushion of the caulk gun handle cushion system adhesively secured to the back caulk gun handle of the representative caulk gun.
Figure 2:
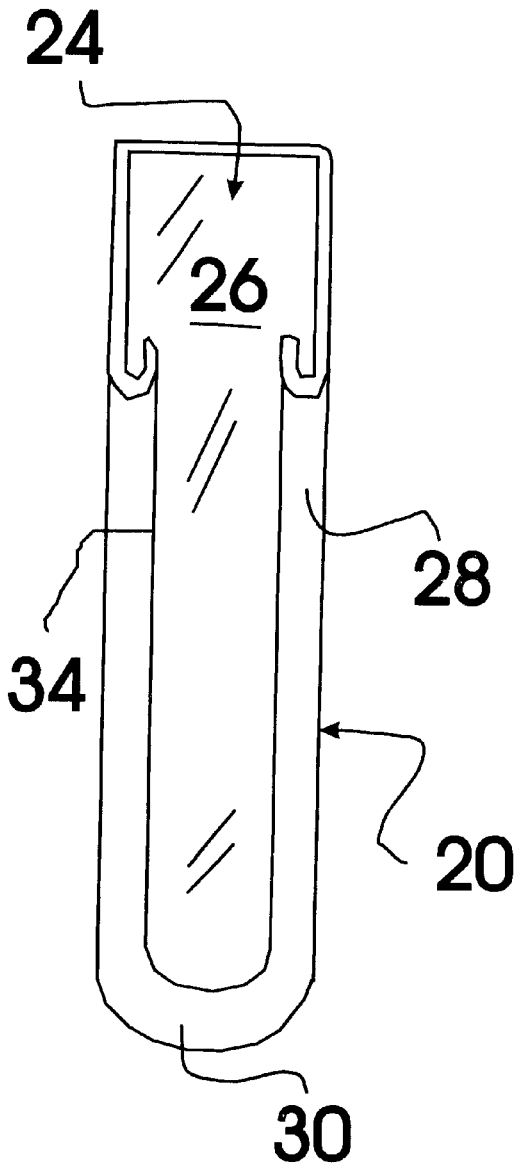
FIG. 2 is a front plan view of the back grip cushion of the caulk gun handle cushion system of the present invention showing the interior caulk gun handle receiving channel coated with an adhesive layer and having left, lower and right overlapping lip sections each also covered with an adhesive layer.
Figure 3:
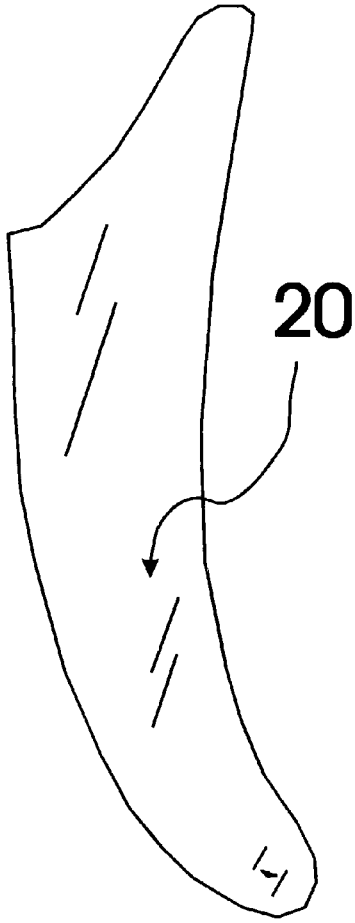
FIG. 3 is a left side plan view of back grip cushion of the caulk gun handle cushion system of the present invention.
Figure 7:
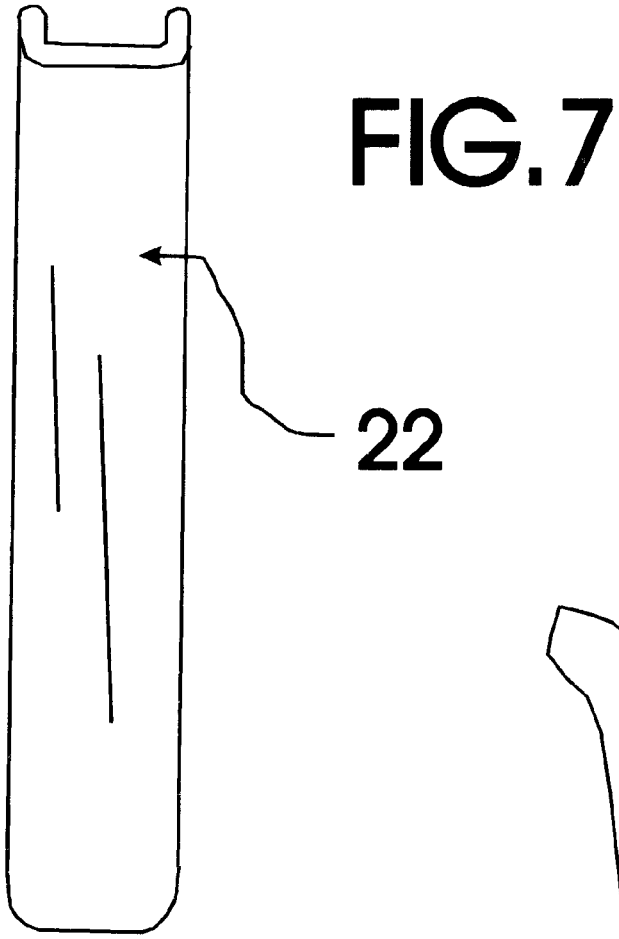
FIG. 7 is a front side plan view of front grip cushion of the caulk gun handle cushion system of the present invention.
Figure 8:
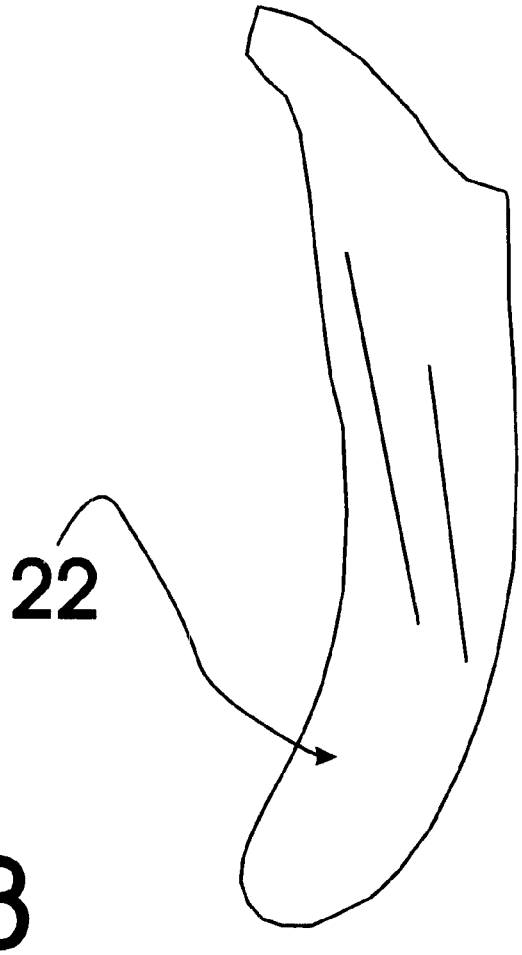
FIG. 8 is a left side plan view of front grip cushion of the caulk gun handle cushion system of the present invention.
Figure 9:
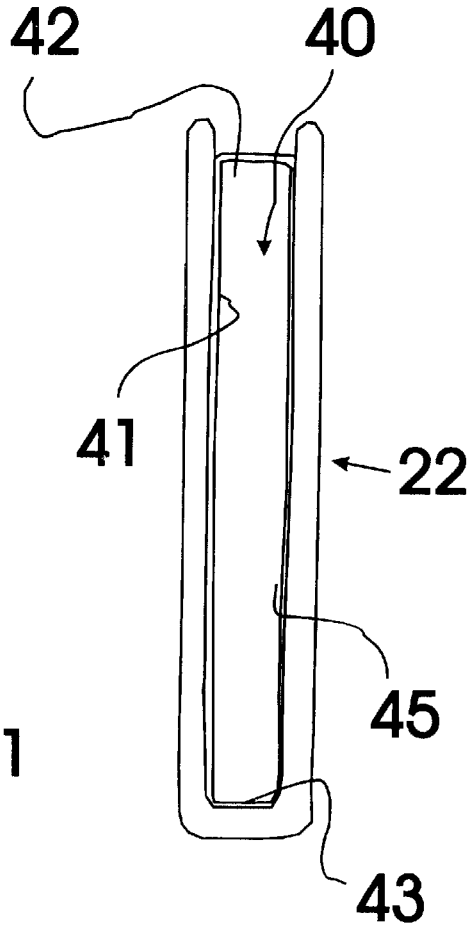
FIG. 9 is a back side plan view of front grip cushion of the caulk gun handle cushion system of the present invention showing a portion of the inner surface thereof coated with a front cushion adhesive surface and having left, lower and right overlapping lip sections each also covered with an adhesive layer.
Figure 10:
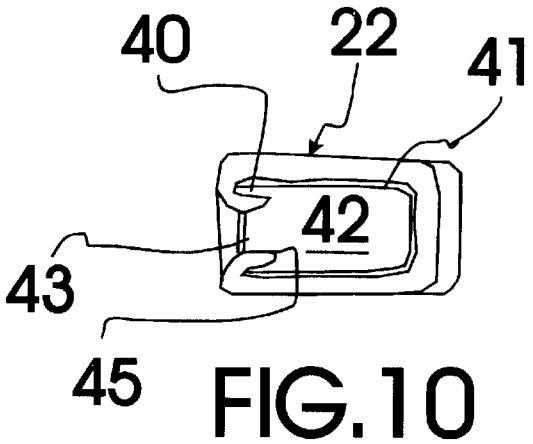
FIG. 10 is a top plan view of front grip cushion of the caulk gun handle cushion system of the present invention showing a portion of the inner surface thereof coated with a front cushion adhesive surface and left, lower and right overlapping lip sections each also covered with an adhesive layer.
Figure 11:
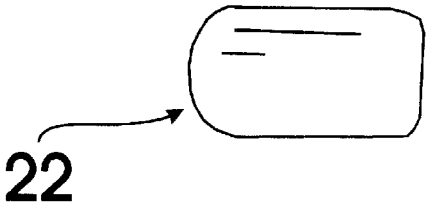
FIG. 11 is a underside plan view of front grip cushion of the caulk gun handle cushion system of the present invention.

FIGS. 1–11 show various aspects of an exemplary embodiment of the caulk gun handle cushion system of the present invention, generally designated 10, that is adapted for use with a caulk gun handle grip assembly, generally designated 12, of a caulk gun 14 having a forwardly curved forward handle grip 16 and rearwardly curved back handle grip 18.

Caulk handle cushion system 10 including a molded, resilient foam, back grip cushion, generally designated 20, adapted for connection with back handle grip 18 of caulk gun handle grip assembly 12 and a molded, resilient foam, forward grip cushion, generally designated, 22, adapted for connection with forward handle grip 16 of caulk handle grip assembly 12.

Referring now specifically to FIGS. 1–6. Back grip cushion 20 includes a interior caulk gun handle receiving channel 24 coated with an adhesive layer 26 and having left 28, lower 30 and right 34 overlapping lip sections each also having an interior surface adhesive layer 26. In use, the back handle grip 18 is inserted completely into handle receiving channel 24 and overlapping lip sections secured over leading edge sections of back handle grip 18. Adhesive layer 26 bonds with and permanently attaches back grip cushion 20 to back handle grip 18.

Referring now to FIGS. 1 and 7–11, front grip cushion 22 has an inner surface defining a forward handle grip receiving cavity 40 that is sized and shaped to conformably receive forward handle grip 16 of caulk gun handle grip assembly 12 and that is covered with an adhesive layer 42 and having left 43, lower 45 and right 47 overlapping lip sections each also coated with interior surface adhesive layer 42. In use, the forward handle grip 16 is inserted completely into handle receiving channel 40 and overlapping lip sections 43,45,47 secured over trailing edge sections of front handle grip 16. When forward handle grip 16 is inserted into forward handle grip receiving cavity 40, adhesive layer 42 bonds with and permanently attaches front grip cushion 22 to front handle grip 16.

It can be seen from the preceding description that a caulk gun handle cushion system has been provided.

It is noted that the embodiment of the caulk gun handle cushion system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A caulk gun handle cushion system for use with a caulk gun handle grip assembly of a caulk gun having a forwardly curved forward handle grip and rearwardly curved back handle grip; the caulk gun handle cushion system including:

a back grip cushion adapted for connection with a back handle grip of a caulk gun handle grip assembly; and a forward grip cushion for the forward handle grip of a caulk gun handle grip assembly;

the back grip cushion includes an interior caulk gun handle receiving channel coated with an adhesive layer and having left, lower and right overlapping lip sections each also covered with an adhesive layer;

the interior caulk gun handle receiving channel being sized and shaped to conformably receive therein the back handle grip of the caulk gun handle grip assembly;

the forward grip cushion having an inner surface defining a forward handle grip receiving cavity covered with an adhesive layer and having left, lower and right overlapping lip sections each also covered with an adhesive layer;

the forward handle grip receiving cavity being sized and shaped to conformably receive the forward handle grip of the caulk gun handle grip assembly.

* * * * *